United States Patent [19]

Norris et al.

[11] 4,173,861

[45] Nov. 13, 1979

[54] METHOD AND APPARATUS FOR CONTROLLING TWIST IN YARN

[75] Inventors: Alan H. Norris; Phillip W. Chambley, both of Rome, Ga.

[73] Assignee: WWG Industries, Inc., Rome, Ga.

[21] Appl. No.: 850,690

[22] Filed: Nov. 11, 1977

[51] Int. Cl.[2] ..... D02G 3/28; D02G 1/16

[52] U.S. Cl. ..... 57/293; 57/290

[58] Field of Search ..... 57/34 R, 34 HS, 34 B, 57/77.3, 157 R, 157 TS, 157 F, 282, 283, 284, 285, 289, 290, 293, 333, 350

[56] References Cited

U.S. PATENT DOCUMENTS

| | | | |
|---|---|---|---|
| Re. 27,717 | 8/1973 | Breen et al. | 57/283 |
| 2,711,627 | 6/1955 | Leath | 57/157 TS |
| 3,309,855 | 3/1967 | Stoll et al. | 57/157 F X |
| 3,468,120 | 9/1969 | Hildebrand | 57/34 R X |
| 3,477,218 | 11/1969 | Hawtin et al. | 57/34 HS |
| 3,717,988 | 2/1973 | Walls | 57/293 |
| 3,855,775 | 12/1974 | Valdelievre | 57/285 X |
| 3,978,647 | 9/1976 | Kosaka et al. | 57/293 X |
| 4,016,715 | 4/1977 | London | 57/157 R X |
| 4,055,039 | 10/1977 | Movshovich et al. | 57/350 X |
| 4,074,511 | 2/1978 | Chambley et al. | 57/34 AT |

*Primary Examiner*—Donald Watkins

*Attorney, Agent, or Firm*—Beveridge, DeGrandi, Kline & Lunsford

[57] ABSTRACT

Singles yarns are formed from a synthetic material, twisted in one direction, heat-set, cooled and false-twisted in the opposite direction. Two similarly treated strands are joined at their nodes and plied, resulting in an improved ply-twist singles twist ratio. The first twisting and heat-setting can be done concurrently using jet twisting with steam, and apparatus for accomplishing this is disclosed.

9 Claims, 4 Drawing Figures

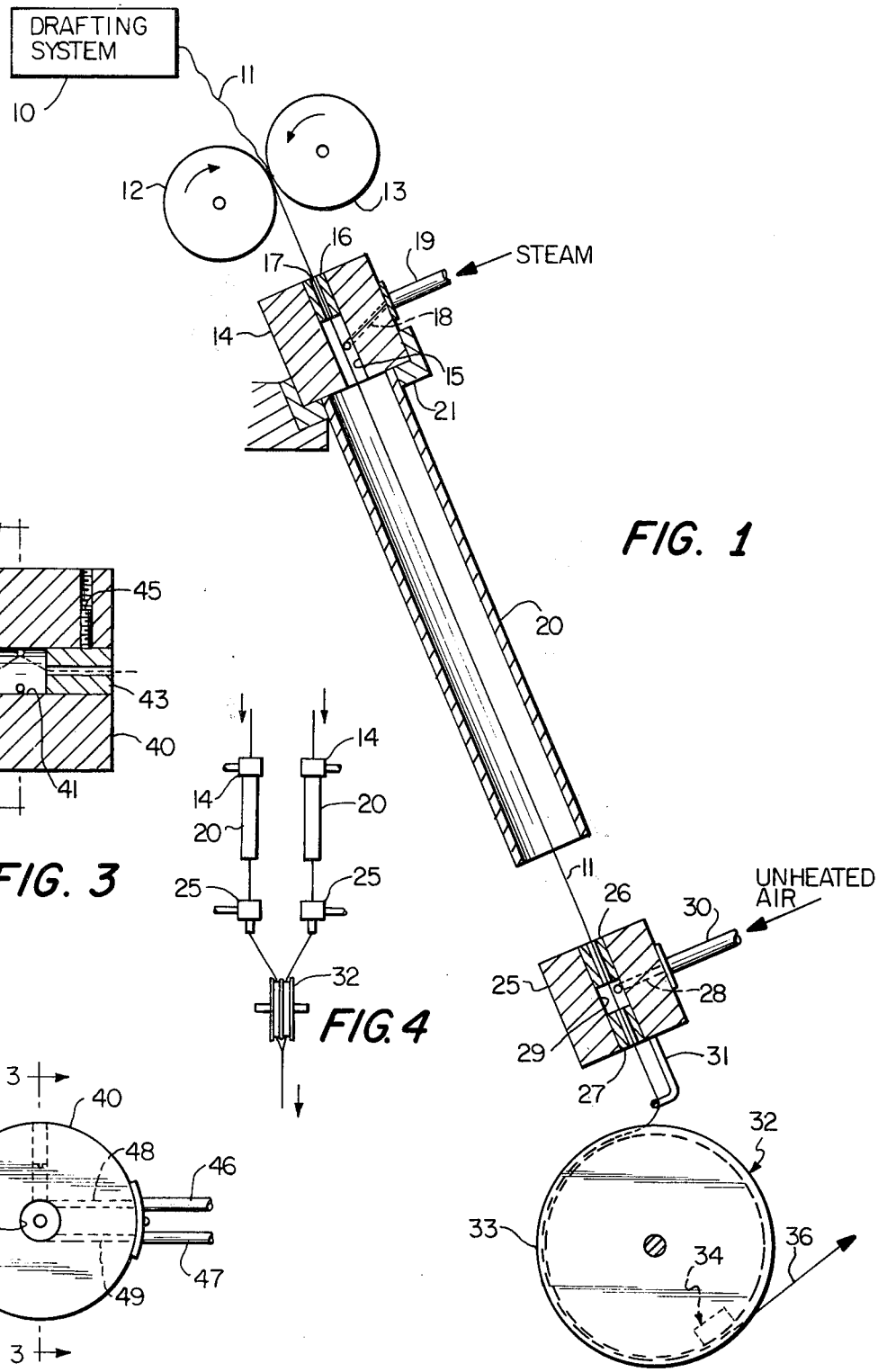
FIG. 1
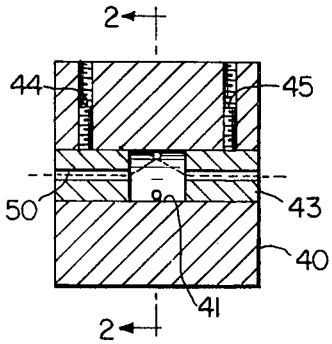
FIG. 3
FIG. 4
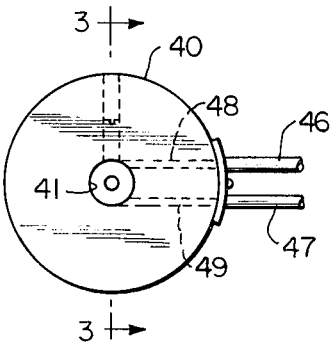
FIG. 2

METHOD AND APPARATUS FOR CONTROLLING TWIST IN YARN

This invention relates to a method and apparatus for making twisted yarn products and particularly to making a yarn having a controlled amount of stable twist.

BACKGROUND OF THE INVENTION

The concept of producing plied yarns using the false-twist, self-twist phenomenon is now rather well known in the art. Documents in which the general principles of false-twisting and self-twisting are described include the following:

"Self-Twist Yarn," D. E. Henshaw, Merrow Publishing Co., Ltd., Watford, Herts, England, 1971 and Pat. Nos.: RE 27,717, Breen et al; 3,225,533, Henshaw; 3,306,023, Henshaw et al; 3,353,344, Clendening, Jr.; 3,434,275, Backer et al; 3,443,370, Walls; 3,507,108, Yoshimura et al; 3,717,988, Walls; 3,775,955, Shah; 3,940,917, Strachan.

Reference is also made to U.S. patent application Ser. No. 755,671, filed in the names of the present inventors on Dec. 30, 1976, now U.S. Pat. No. 4,074,511, which discloses apparatus usable with the present invention.

For purposes of convenience, some general comments concerning false-twisted and self-twisted plied yarn will be described. It is possible to form a plied yarn by false-twisting two or more singles yarn strands, attaching the strands to each other and then permitting the strands to wrap about each other using the release of forces stored by the false-twisting to accomplishing the plying, hence the term "self-twist." The false-twisting itself, in simplified form, involves holding spaced points of a yarn strand and twisting the strand in one direction at a point intermediate the held points, e.g., the center. This produces twists on one side of the center in one direction and on the other side of the center in the opposite direction. The center of the twisted strand constitutes a point of twist reversal and is called a "node." Clearly, energy is stored in the strand in the twisting step. When two strands similarly false-twisted in the same direction are brought together in side-by-side juxtaposition with their ends held and permitted to act against or with each other by releasing a central node, the stored forces cause the strands to ply, i.e., to wrap around each other spontaneously. The process is enhanced and the product made more stable if the nodes of the two strands are aligned and are joined or locked together before release and plying.

As will be recognized, the torque or twist force exerted by each strand is roughly proportional to the amount of false twist inserted therein and that such force decreases as the strands ply. The plying step itself therefore continues until the stored twist forces in each strand decrease to a point at which the remaining twist forces are exactly counterbalanced by the resistance to further twisting in the plied yarn. Thus, if one begins with individual strands and then false twists the strands and plies them, each strand will end up, in the plied yarn, with some degree of false-twist which can be thought of as some remaining stored potential energy, the force exerted thereby being too small to cause further ply twisting against opposing frictional and reverse direction torque forces in the plied yarn. In a stable plied yarn formed in this fashion, the amount of singles twist always is greater than the amount of ply twist.

Generally speaking, this remaining stored force or energy may not be particularly disadvantageous, depending upon the type of fabric to be produced from the plied yarn. However, when the yarn is to be used to produce certain products such as cut pile carpet, the relationship of the remaining twist in the singles yarn to the amount of ply twist becomes highly significant because of the appearance of the product produced therefrom. In particular, it has been found highly desirable to increase the ratio of ply twist to singles twist in carpet yarns, and that such increase has the desirable effect of eliminating adverse conditions in the finished carpet such as lack of retention of twist in the cut pile tuft tips.

BRIEF DESCRIPTION OF THE INVENTION

An object of the present invention is to provide a method for producing synthetic yarns having an increased ratio of ply twist to singles twist.

A further object is to provide an apparatus for treating singles yarn to incorporate false-twist characteristics therein such that, when the yarn is plied with similar yarns, the ratio of ply twist to singles twist is increased.

Briefly described, the invention includes a method of preparing a false-twisted singles yarn for incorporation in a plied yarn to obtain an increased ratio of ply twist to singles twist therein comprising the steps of forming a singles yarn strand from a synthetic material having a known glass transition temperature, imparting a first predetermined amount of twist to the singles yarn strand in a first direction, heating the twisted strand to a temperature at least as great as the glass transition temperature of the material, subsequently cooling the twisted strand below its glass transition temperature, and imparting a second predetermined amount of twist to the strand in the opposite direction.

The method can also include periodically reversing the directions of twist to form a false-twisted strand having spaced regions of longitudinally alternating twist separated by nodes of twist reversal such that a plied yarn can be formed from a plurality of strands so treated.

The invention also includes an apparatus for treating a yarn strand comprising means for forming a singles yarns strand from a material having a known glass transition temperature, first fluid jet twist means downstream of said means for forming for receiving said strand and selectively imparting twist in either direction to said strand, said twist means having an axial yarn passage therethrough, means for supplying steam or hot gas under pressure to said passage in said first twist means, an elongated tube extending coaxially away from the output end of said passage, second fluid jet twist means downstream of and spaced from said tube for receiving said strand and selectively imparting twist in either direction to said strand, said second twist means having an axial yarn passage therethrough, means for supplying air to said second twist means at a temperature below the glass transition temperature, and means for receiving said strand from said second twist means.

In order that the manner in which the foregoing and other objects are attained in accordance with the invention can be understood in detail, particularly advantageous embodiments thereof will be described with reference to the accompanying drawings, which form a part of this specification, and wherein:

FIG. 1 is a schematic side elevation, partly in block form, of an apparatus in accordance with the invention;

FIG. 2 is a plan view of a fluid jet twist device usable in the apparatus of FIG. 1;

FIG. 3 is a side elevation, in section, along lines 3—3 of FIG. 2; and

FIG. 4 is a schematic diagram illustrating a typical arrangement for forming a plied yarn using the apparatus of FIG. 1.

By way of introduction, it will be recognized that synthetic yarns such as, for example, nylon, polyester and polypropylene exhibit physical changes which are associated with temperature. Such "plastics" fibers or yarns made from polymers such as these are capable of accepting a certain level of stress or deformation and still return to their original physical dimensions and shape when the stress or deformation forces are removed. It is certainly true that some deformation is permanent if values of stress are used to a magnitude such as to induce plastic flow. However, where the polymer is below its second order transition temperature, or glass transition temperature, and it has been fully drawn into a yarn or thread for textile use, the deformation or stretch which can be tolerated before breaking is relatively small.

At the glass transition temperature, the polymer begins to acquire the ability to relieve the stress internally. This is not a sudden change and at the glass transition temperature the relief of stress is relatively slow. However, as the temperature is raised above the glass transition temperature, the rate at which the stress is relieved increases.

Heat-setting of a synthetic yarn of this type refers herein to the process of elevating the temperature of the yarn above its glass transition temperature, high enough and for long enough to completely relieve all stresses previously induced in the fibers. Before heat-setting, such stresses are normally present in spun yarns due to singles twist and ply twist procedures and processing tensions in the yarn processing.

Following are glass transition temperatures for some examples of synthetic fibers:

Nylon (6 or 6.6)
- Wet—about 20° C.
- Dry—40°-60° C.

Polyester
- Wet—60°-80° C.
- Dry—115°-120° C.

Highly oriented polyester (tire cord)
- Wet—60°-70° C.
- Dry—80°-100° C.

Acrylic
- Below room temperature

Polypropylene
- Wet—126°-132° C.
- Dry—135°-140° C.

It will be observed that heat-setting conditions could range from, for polypropylene, about 20 minutes at 130° C. to 5-10 seconds at 200° C. Thus, the glass transition temperature represents the temperature at which plastics stress release commences. However, it will also be observed that whenever a fiber under stress is elevated in temperature to a point above this glass transition temperature, some stress relief occurs. Thus, if a twisted yarn is taken above its glass transition temperature, the tendency of the yarn to untwist when released is reduced in proportion to the temperature and duration of the heating above the transition temperature.

The present invention takes advantage of these properties in preparing a singles yarn for incorporation into a plied yarn having improved twist radio characteristics. In this context, it will be recognized that the expression "singles twist" refers to an amount of twist, usually measured in turns per inch (tpi) with respect to its own axis, while the term "ply twist" refers to the number of turns per inch made by yarns with respect to the axis of the plied yarn. As previously indicated, yarns which are false-twisted cold and then permitted to ply cold tend to reach a state in which the singles and ply twists are only unequal, or in which the ratio of ply twist to singles twist is rather less than one. Also, it will be recognized that the singles twist referred to is the initial twist before plying.

If a short length of untwisted fibers were twisted in an S direction, for example, at a temperature well below the glass transition temperature, and then released, nearly all of the twist would be removed, with the possible exception of a very small amount relating to cold plastic flow. If the cold twisted fibers were then twisted in the Z direction and released, the fibers would again return to nearly zero twist and, additionally, the small remaining twist attributable to cold plastic flow would be cancelled.

However, if the fibers were heated above their glass transition temperature while twisted in the S direction, some S twist would remain upon cooling and release. If these fibers were then twisted in the Z direction while cold, they would not return to zero twist but, instead, would return to the S-twist configuration induced while heated.

As an example, assume that five turns per inch of S twist is inserted into a singles strand and the strand is heated above the glass transition temperature for the material from which the strand was formed. Upon cooling and release, it would be reasonable to expect two turns of S twist to remain in the strand. If the cold strand is then twisted until it exhibits five tpi in the Z direction, and released, the fibers would rotate seven turns per inch, returning to the condition of two tpi of S twist.

If two such strands were twisted to the five tpi state in the Z direction, placed adjacent to each other and released, the self-plying torque available would be equivalent to that of seven tpi which would result in an approximately 40% higher ply twist in the final plied yarn. The singles twist, however, would be near zero. Thus, the resulting yarn would have a somewhat increased ratio of ply twist to singles twist compared with a yarn with the same amount of Z singles twist but not previously heat-set in an S configuration.

The foregoing brief explanation can be more fully understood by reference to the following example:

EXAMPLE

Twenty inches of yarn, 1250 denier, continuous filament nylon, were given 100 actual turns of S twist and the twist was then released and allowed to "run out." The yarn was then returned to zero twist. One hundred turns of twist in the Z direction (5 tpi) were then inserted into the yarn and the yarn was folded on itself and permitted to ply from the center, both ends being held together in one clamp. The yarn formed 26 turns of S ply, meaning that the twist configuration had a ratio of 5 Z turns of singles twist to 2.6 ply turns of S twist.

The experiment was repeated with a fresh length of yarn, but this time after inserting the 100 turns of singles yarn twist in the S direction, the yarn was heated to 200° F. for five seconds by immersing the yarn in hot water. It was then cooled and twisted in the Z direction until it contained 100 Z turns. It was then folded on itself and allowed to ply as before. The yarn formed 44 turns of S ply. Thus, the twist configuration exhibited a ratio of 5 turns of Z singles twist to 4.4 turns of S ply twist. Thus, the ratio of ply twist to singles twist had been improved 69% by the heat treatment and reverse twist.

This method can be implemented in a production context by an apparatus such as that illustrated in FIG. 1 wherein yarn is formed in a conventional drafting system indicated generally at 10, which is conventional in nature and will not be described in detail. The yarn 11 emerging from the drafting system is caused to pass between rolls 12 and 13 to position the yarn and control the longitudinal tension therein through a processing zone. The yarn passes through first fluid twist jet device 14 which comprises a body having an axial yarn passage 15 therethrough. An insert 16 at the inlet end of passage 15 can be employed to control the motion of the yarn in the twisting process, insert 16 having a central bore 17 to permit passage of the yarn.

The body of the twist jet has two passages 18, only one of which is visible in the sectional view of FIG. 1, these passages entering the body and intersecting passage 15 tangentially so that fluid injected through the passage enters the bore 15 and flows in a circular pattern. It will be observed that the passage is not perpendicular to the central axis of passage 15 but, instead, is angled so that the fluid follows a helical path, thus tending to propel the yarn toward the outlet end of the passage. A tube 19 is connected to each fluid inlet passage to permit fluid under pressure to be injected therein. Thus, if fluid is supplied to one of the passages, clockwise helical flow is produced and if fluid is supplied in the other passage, counterclockwise flow is produced. By selecting the passage, the direction of fluid vortex flow within passage 15 can thus be controlled, thereby twisting the yarn in either direction as it passes through the twist jet. As indicated, the yarn can simultaneously be heated by connecting a source of steam to tubes 19.

A tubular heating chamber 20 extends coaxially away from passage 15 and is connected to the twist device by any suitable mechanical means such as an attachment collar 21. Tube 20 has an elongated interior bore through which the yarn passes and through which the steam also passes, thereby providing a heat-setting chamber within which the yarn can continue to be heated for some interval after it leaves the twist jet device. Yarn 11 then emerges from the outlet end of the tube and enters a second twist jet device 25 which is substantially identical to twist jet 14 except that it includes an insert 26 at the inlet end and an insert 27 at the outlet end. Again, twist jet 25 includes passages 28 which tangentially intersect a central yarn passage 29 through which the yarn passes, passages 28 being connected to tubes 30 through which fluid under pressure can be supplied for twisting the yarn. In twist jet 25, however, unheated air under pressure is supplied through tubes 30 to cool the yarn as it passes therethrough.

At the outlet end of twist jet 25 is a wire guide 31, which can be a simple wire loop, so that yarn 11 can change direction and be conducted onto a yarn wheel 32.

At this point, the yarn can be collected, but it can also be associated with similarly processed yarns and plied therewith. A yarn wheel suitable for this purpose is disclosed in previously mentioned patent application Ser. No. 755,671, and will not be described herein in detail. However, for purposes of completeness, it will be noted that the yarn wheel includes a plurality of circularly extending flanges 33 which are axially spaced apart to define circularly extending guide paths for yarns. If two or more devices including the twist jets and tube 20 are supplied to feed yarn onto a yarn wheel of this type, the yarns placed thereon can be brought together and permitted to ply. Advantageously, the yarn wheel is supplied with a node fixation device indicated generally at 34, this device being placed in a position so that it is exposed to the guide surfaces and to the yarns carried thereon. The yarn wheel is rotatable on an axis 35 and the rotation thereof is synchronized with delivery of yarns to the wheel such that the fixation device comes in contact with the yarns at the node points of twist reversal. The fixation device as described in the aforementioned patent application includes a rotating abrasive wheel which engages the fibers of the yarns and causes them to be entangled, thereby fixing or locking the nodes together. Then, as the yarn leaves wheel 32, it plies together and the plied yarn 36 can be collected for later use or immediately delivered to a machine such as a carpet tufting machine. The node locking in this manner prevents false twist inserted in the individual yarns from extending beyond the node points, and the ply twist resulting therefrom is a more stable and reliably predictable product.

FIGS. 2 and 3 illustrate twist jet devices which can be used for jets 14 and 25. As shown therein, the twist jets include a body portion 40, a central bore and inserts 42 and 43, the axial positions of the inserts being adjustable by set screws 44 and 45. Tubes 46 and 47 are attached to the exterior surface of the bodies and are connected to axial passage 48 and 49, respectively, to tangentially supply fluid under pressure to bore 41. As best seen in FIG. 3, the yarn 50 is caused to rotate about the interior chamber in bore 41 and is thereby twisted.

FIG. 4 schematically illustrates the use of two devices to treat yarn as previously described and to supply it to a yarn wheel. As shown therein, there are two twist jets 14 which are supplied with steam under pressure to initially twist and heat the yarn, two tubes 20 and two tube twist units 25 delivering yarn to a yarn wheel 32 on which the nodes can be locked and from which the yarns can ply together.

While certain advantageous embodiments have been chosen to illustrate the invention, it will be understood by those skilled in the art that various changes and modifications can be made therein without departing from the scope of the invention as defined in the appended claims.

What is claimed is:

1. A method of preparing a false-twisted singles yarn for incorporation in a plied yarn to obtain an increased ratio of ply twist to singles twist therein comprising the steps of imparting a first predetermined amount of twist to the singles yarn strand in a first direction;

heating the twisted strand to a temperature at least as great as the glass transition temperature of the material;

subsequently cooling the twisted strand below the glass transition temperature; and imparting a second predetermined amount of twist in the opposite direction to that portion of the strand which was subjected to said twisting, heating and cooling steps.

2. A method according to claim 1 wherein the step of imparting a first amount of twist is performed in a twist jet, and wherein the step of heating is concurrently performed by supplying the twist jet with steam.

3. A method according to claim 2 wherein the step of imparting a second amount of twist is performed in a second twist jet supplied with unheated air.

4. A method according to claim 3 wherein the singles yarn strand is continuously moved through the twist jets, and wherein both of the directions of twist are periodically reversed to form a false-twisted strand having spaced regions of longitudinally alternating twist separated by nodes of twist reversal.

5. A method of forming a plied yarn comprising the steps of continuously longitudinally moving a plurality of singles yarn strands formed of a synthetic material having a known glass transition temperature;

imparting first predetermined amount of twist to portions of each of said strands heating said portions of each of the twisted strands to a temperature at least as great as the glass transition temperature of the synthetic material;

subsequently cooling said portions of each of the twisted strands below the glass transition temperature;

imparting second predetermined amounts of twist to said portions of each of the strands which are subjected to said twisting, heating and cooling steps, said second predetermined amounts of twist for each strand being in a direction which is opposite to the direction of the first predetermined amount of twist; and bringing the strands into contiguous relationship and permitting the strands to ply together into a self-twisted, plied yarn.

6. A method according to claim 5 wherein the first and second directions of twist are periodically reversed to form false-twisted strands each having spaced regions of longitudinally alternating twist separated by nodes of twist reversal.

7. A method according to claim 6 wherein the step of bringing the strands into contiguous relationship includes aligning the nodes of the strands with each other so that regions of like twist are side-by-side, the method further including, before the step of permitting the strands to ply together, the step of joining the aligned nodes of the strands to each other.

8. An apparatus for treating a yarn strand comprising means for forming a singles yarn strand from a material having a known glass transition temperature;

first fluid jet twist means downstream of said means for forming for receiving said strand and selectively imparting twist in either direction to said strand, said twist means having an axial yarn passage therethrough;

means for supplying steam under pressure to said passage in said first twist means;

an elongated tube extending coaxially away from the output end of said passage;

second fluid jet twist means downstream of and spaced from said tube for receiving said strand and selectively imparting twist in either direction to said strand, said second twist means having an axial yarn passage therethrough;

means for supplying air to said second twist means at a temperature below said glass transition temperature; and means for receiving said strand from said second twist means.

9. The method of claim 5 wherein the second predetermined amounts of twist for both said strands is in the same direction.

* * * * *